US007438028B1

(12) United States Patent
Warren

(10) Patent No.: US 7,438,028 B1
(45) Date of Patent: Oct. 21, 2008

(54) FOUR STROKE ENGINE WITH A FUEL SAVING SLEEVE

(76) Inventor: Edward Lawrence Warren, 3912 Snowy Egret Dr., West Melbourne, FL (US) 32904

( * ) Notice: Subject to any disclaimer, the term of this patent is extended or adjusted under 35 U.S.C. 154(b) by 0 days.

(21) Appl. No.: 11/732,820

(22) Filed: Apr. 5, 2007

(51) Int. Cl.
*F02B 75/36* (2006.01)
*F02F 1/00* (2006.01)

(52) U.S. Cl. ..... 123/48 C; 123/78 C; 123/193.2

(58) Field of Classification Search ..... 123/311, 123/312, 193.1, 193.2, 78 R, 78 A, 78 AA, 123/78 C, 48 R, 48 A, 48 AA, 48 C
See application file for complete search history.

(56) References Cited

U.S. PATENT DOCUMENTS 1,809,585 A * 6/1931 Edwards ..... 123/312
2,451,271 A * 10/1948 Balster ..... 123/54.4
4,164,916 A * 8/1979 Wuerfel ..... 123/78 C
6,216,653 B1 * 4/2001 Hara et al. ..... 123/90.11
7,159,544 B1 * 1/2007 Studdert et al. ..... 123/48 B

* cited by examiner

*Primary Examiner*—Stephen K Cronin
*Assistant Examiner*—Ka Chun Leung

(57) ABSTRACT

A four stroke engine with piston strokes all of equal length whereby the intake stroke displacement and the compression stroke displacement are smaller than the expansion stroke displacement and the exhaust stroke displacement. This is accomplished using the fuel saving sleeve that has a projection on one end. A magnetic force is used to keep the fuel saving sleeve at the top of the engine cylinder during the intake and compression strokes. This makes the sleeve act as an air displacer during the intake and compression strokes. The projection transfers the pressure of burning gases on the sleeve to the piston during the expansion stroke. It also transfers force from the piston to the sleeve during the exhaust stroke. This makes the sleeve act as an enlargement of the piston during the expansion and exhaust strokes.

3 Claims, 5 Drawing Sheets

FOUR STROKE ENGINE WITH A FUEL SAVING SLEEVE

FIELD OF INVENTION

The present invention relates to four stroke engines. More specifically, the present invention relates to a fuel saving sleeve (hereafter referred to as a sleeve). It is a hollow cylinder that the engine piston fits inside of and the sleeve in turn fits inside of the engine cylinder. The sleeve has a projection and magnets at one end, and increases the power and efficiency of a four stroke engine.

BACKGROUND

Description of Prior Art

The basic components of a four stroke engine are well known in the art and include the cylinder head, cylinders, pistons, igniters, fuel injectors (or some other means of fuel input), and valves. The cylinder heads, cylinders and the space above the tops of the pistons typically form chambers into which heat is introduced. Such an engine usually gains its energy from fuel being burned. This heat input is part of the thermodynamic cycle of the device.

The four stroke engine, a concept whose basic design has not changed even though it has had much development, has been the engine of choice for over a hundred years. This is because of its simplicity and outstanding performance as a prime mover in the ground transportation and other industries. In a four-stroke engine, power is recovered from the heat addition process in four separate piston movements (strokes) of a single piston. Accordingly, a four stroke engine is defined herein to be an engine which requires four complete strokes of one or more pistons for every expansion (or power) stroke, i.e. for every stroke that delivers power output. The above four complete strokes are: air intake stroke, compression stroke, expansion stroke, and exhaust stroke.

Roughly one third of the heat input to the engine is used as power output, one third is dissipated from the radiator, and one third goes out the exhaust. A quick fix is needed to minimize the heat going out the exhaust.

The goal of engine developers has been to create an engine that was very efficient. To do this they have tried to create an engine that developed just enough power to move a vehicle on the road at seventy miles an hour. This engine was under powered but efficient. To make up the power needed to get the vehicle from zero to seventy miles an hour (four to six times the power needed to move a vehicle on the road at seventy miles an hour) they augmented the engine by over-revving and gearing down, by supercharging, by water injection, by additional stand-by cylinders, and by electric motors.

Most of the present four stroke engines do not fully expand their charge. They open the exhaust valve while there is still a large quantity of energy left in the charge, and this large quantity of energy is wasted. Super-charging and water injection are severely limited by this inability to fully expand the charge.

What is needed is a quick fix to the present four stroke engine that allows greater expansion of the charge after compression and heating, and more effective super-charging and water injection.

SUMMARY

The object of this invention is to allow greater expansion of the charge after compression and heating by simply adding a sleeve to a four stroke engine.

The present invention is a four stroke engine with a sleeve. The sleeve is a hollow cylinder that the engine piston or another sleeve fits inside of, and the sleeve in turn fits inside of the engine cylinder. The sleeve has a projection and magnets attached to it. The magnets keep the fuel saving sleeve at the top of the engine cylinder during the intake and compression strokes while the piston moves up and down inside of the fuel saving sleeve. The projection is a top on the sleeve with a hole in the middle smaller in diameter than the diameter of the piston. The projection transfers the pressure of burning gases on the fuel saving sleeve to the piston during the expansion strokes as they both move down, and the projection moves the fuel saving sleeve up with the piston during the exhaust strokes. Two fuel saving sleeves; one inside the other can be used to get higher effectiveness from super-charging or water injection.

OBJECTS AND ADVANTAGES

The four stroke engine with a sleeve has the following advantages:

The engine it is installed in operates on a very efficient thermodynamic cycle.

The engine it is installed in can operate with complete expansion.

It is an inexpensive quick fix that allows greater expansion of the charge after compression and heating.

It increases the effectiveness of super-charging and water injection.

DRAWING FIGURES

REFERENCE NUMERALS IN DRAWINGS

Figure 1:
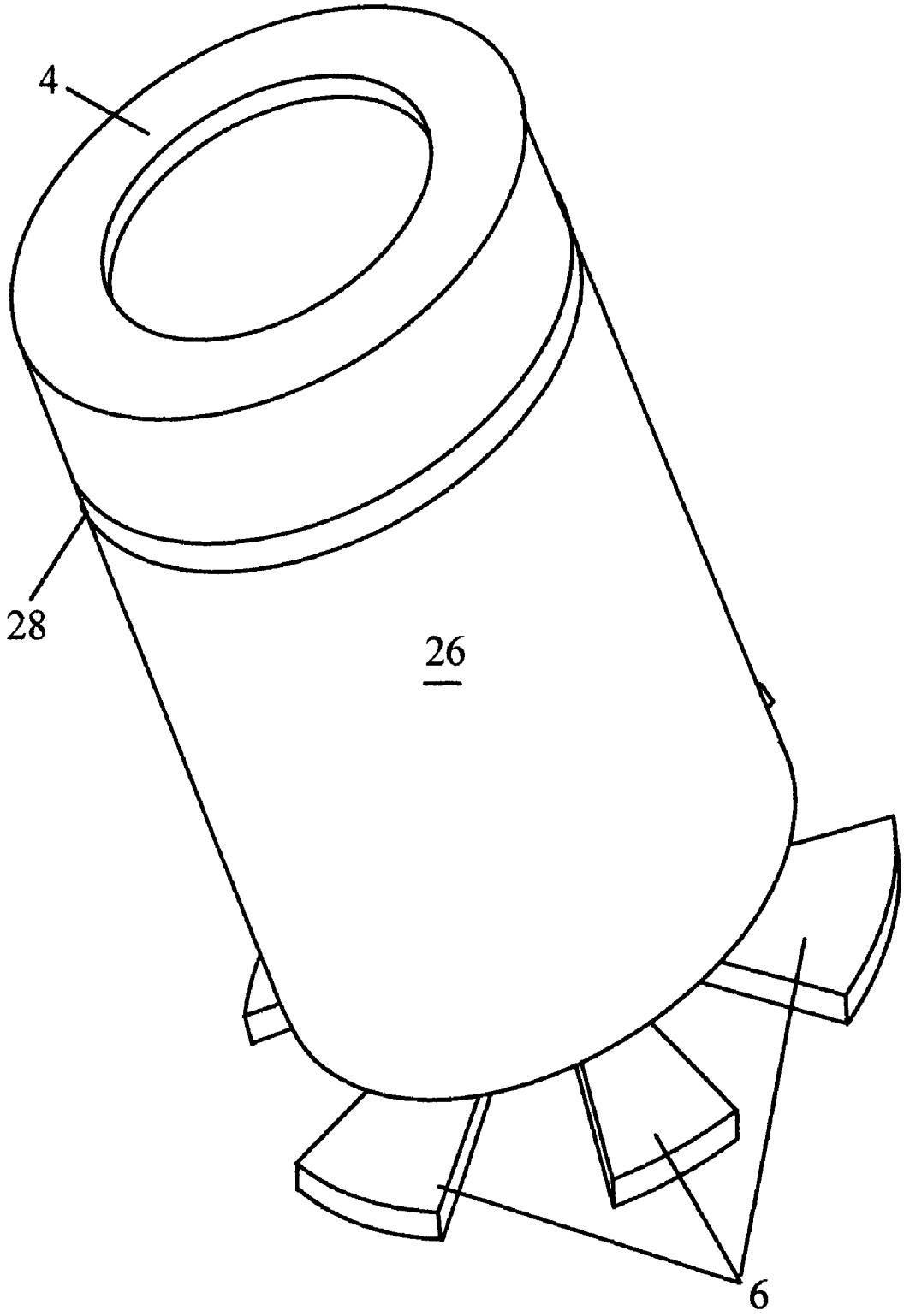
FIG. 1 shows the sleeve of the preferred embodiment of this invention.

4. projection
6. first sleeve magnets
7. second sleeve tang
8. four stroke engine
10. air inlet valve
12. engine cylinder
14. piston
16. exhaust valve
18. fuel injector
20. igniter
22. cylinder head
24. electro-magnet
26. first sleeve
27. second sleeve
28. piston ring groove

DESCRIPTION

Figure 2:
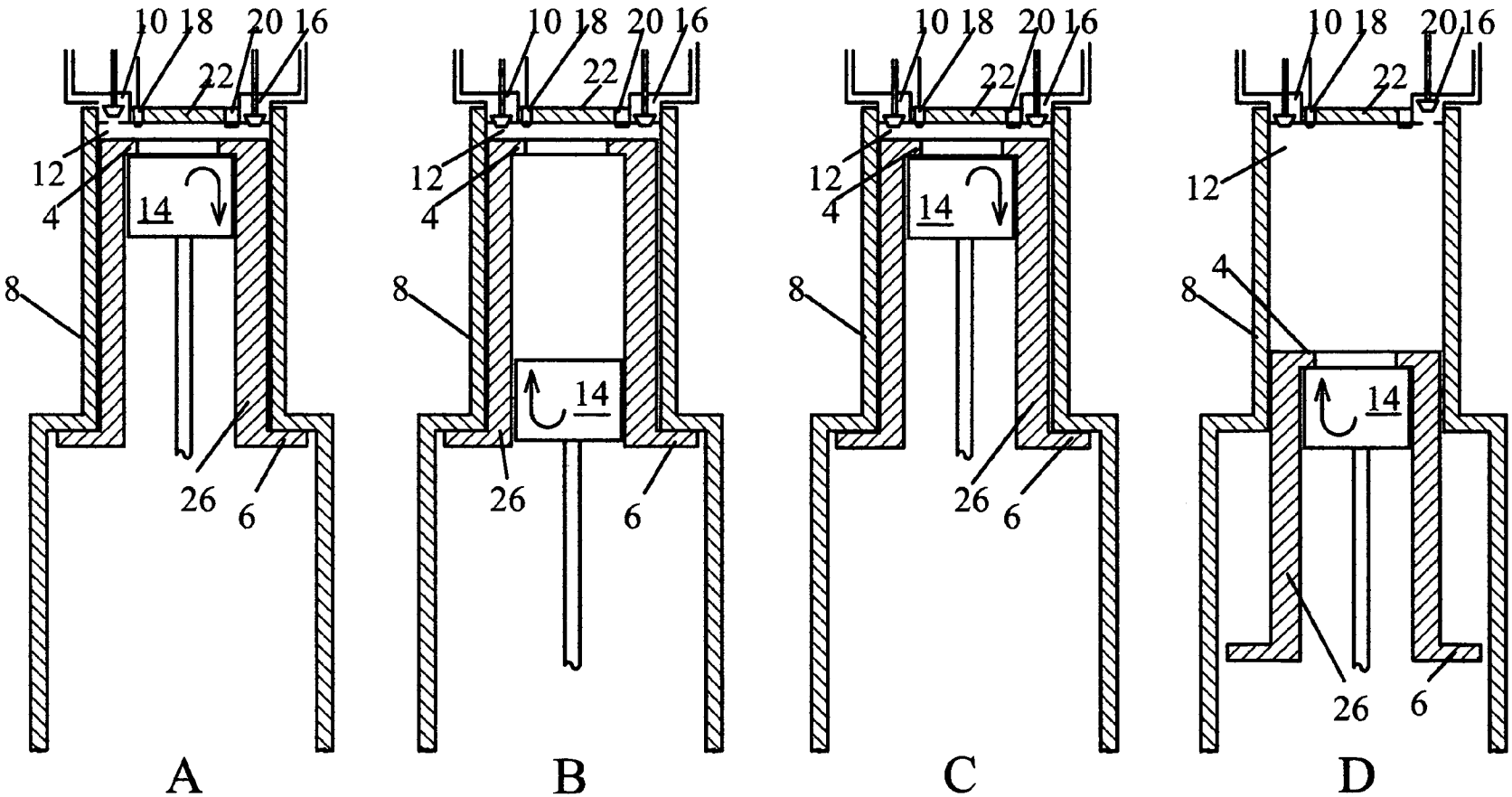
FIG. 2 shows the operation of the preferred embodiment of this invention.

FIGS. 1 and 2—Preferred Embodiment

Down or downward means away from cylinder head 22, and up or upward means toward cylinder head 22. Top means near cylinder head 22 and bottom means away from cylinder head 22.

FIG. 1. Shows first sleeve 26 of the preferred embodiment of this invention. It has projection 4 at the top and first sleeve magnets 6 at the bottom attached so that they stick out perpendicular to the outer wall of first sleeve 26. The outside of first sleeve 26 has piston ring groove 28 cut in it.

Shown in FIG. 2 is four stroke engine 8 comprising air inlet valve 10, engine cylinder 12, piston 14, exhaust valve 16, fuel injector 18 and igniter 20 for adding heat, cylinder head 22, first sleeve 26, projection 4 for transferring force between first sleeve 26 and piston 14, and first sleeve magnets 6 along with material that is attracted by a magnet in engine cylinder 12 for creating a magnetic force for keeping first sleeve 26 at cylinder head 22 end of said engine cylinder 12 until a predetermined force generated by the heating of the air makes it move.

As shown in FIG. 2, in four stroke engine 8, piston 14 fits inside of first sleeve 26, and first sleeve 26 in turn fits inside of engine cylinder 12. Air enters engine cylinder 12 through air inlet valve 10, and leaves engine cylinder 12 through exhaust valve 16.

Air inlet valve 10, exhaust valve 16, fuel injector 18, and igniter 20 are all in cylinder head 22.

OPERATION

FIG. 2—Preferred Embodiment

FIG. 2 shows the operation of the preferred embodiment. Down or downward means away from cylinder head 22, and up or upward means toward cylinder head 22. Top means near cylinder head 22 and bottom means away from cylinder head 22.

Air is taken into four stroke engine 8 between FIGS. 2A and 2B. During this downward intake stroke of piston 14, material in engine cylinder 12 that is attracted by first sleeve magnets 6 create a magnetic force for keeping first sleeve 26 at the top of engine cylinder 12. Air is compressed between FIGS. 2B and 2C. During this upward compression stroke of piston 14, first sleeve magnets 6 keep first sleeve 26 at the top of engine cylinder 12. Heat is added in FIG. 2C. The air is expanded between FIGS. 2C and 2D. At the start of the downward expansion stroke, first sleeve magnets 6 are overpowered by predetermined forces caused by the heating of the air pushing against the top of first sleeve 26, and first sleeve 26 moves down as projection 4 transfers force from first sleeve 26 to piston 14. Air is exhausted between FIGS. 2D and 2A. During the upward exhaust stroke, projection 4 transfers force from piston 14 to first sleeve 26 and moves first sleeve 26 to the top of engine cylinder 12.

DESCRIPTION

Figure 3:
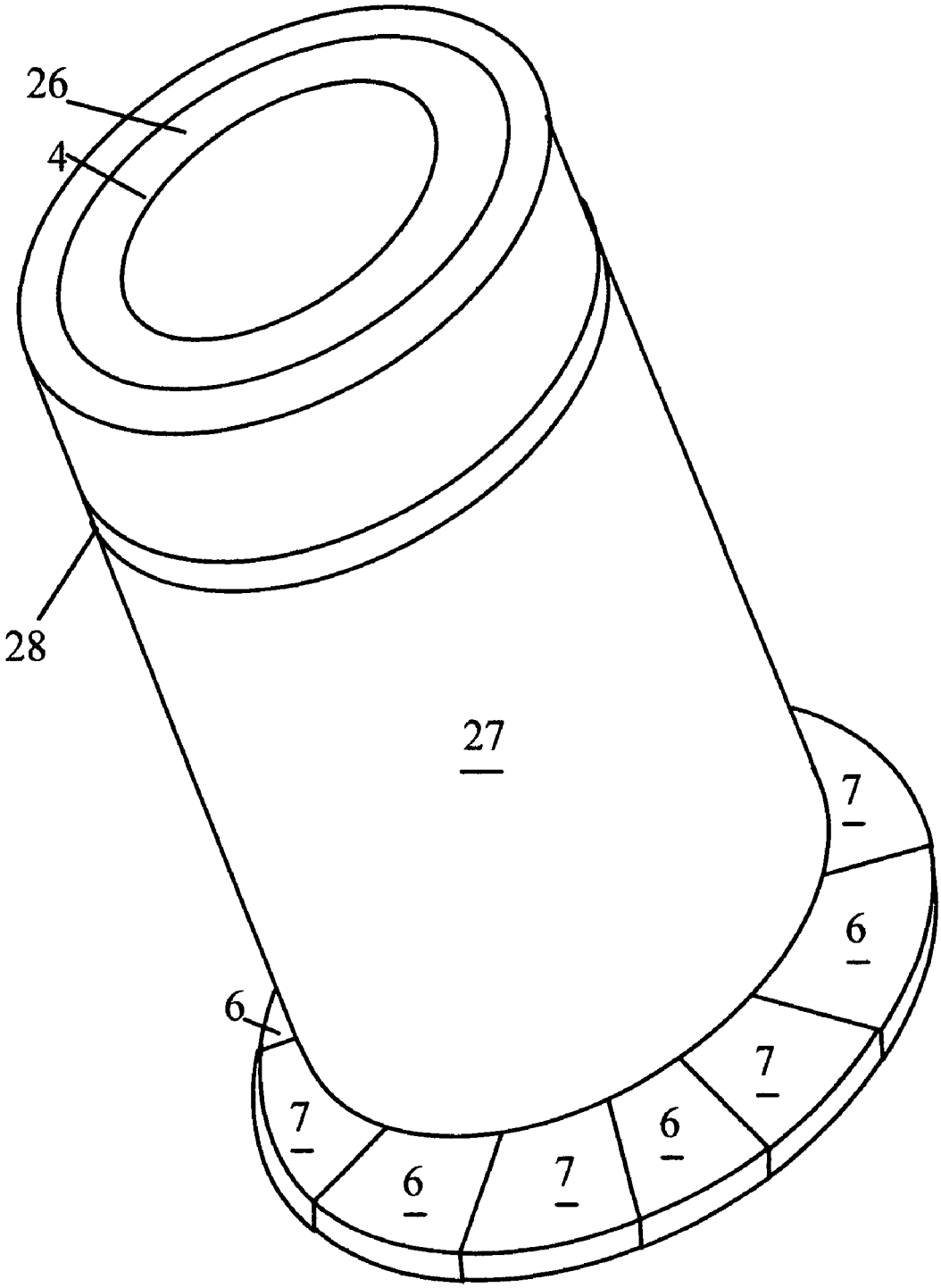
FIG. 3 shows the first alternate embodiment of this invention.
Figure 4:
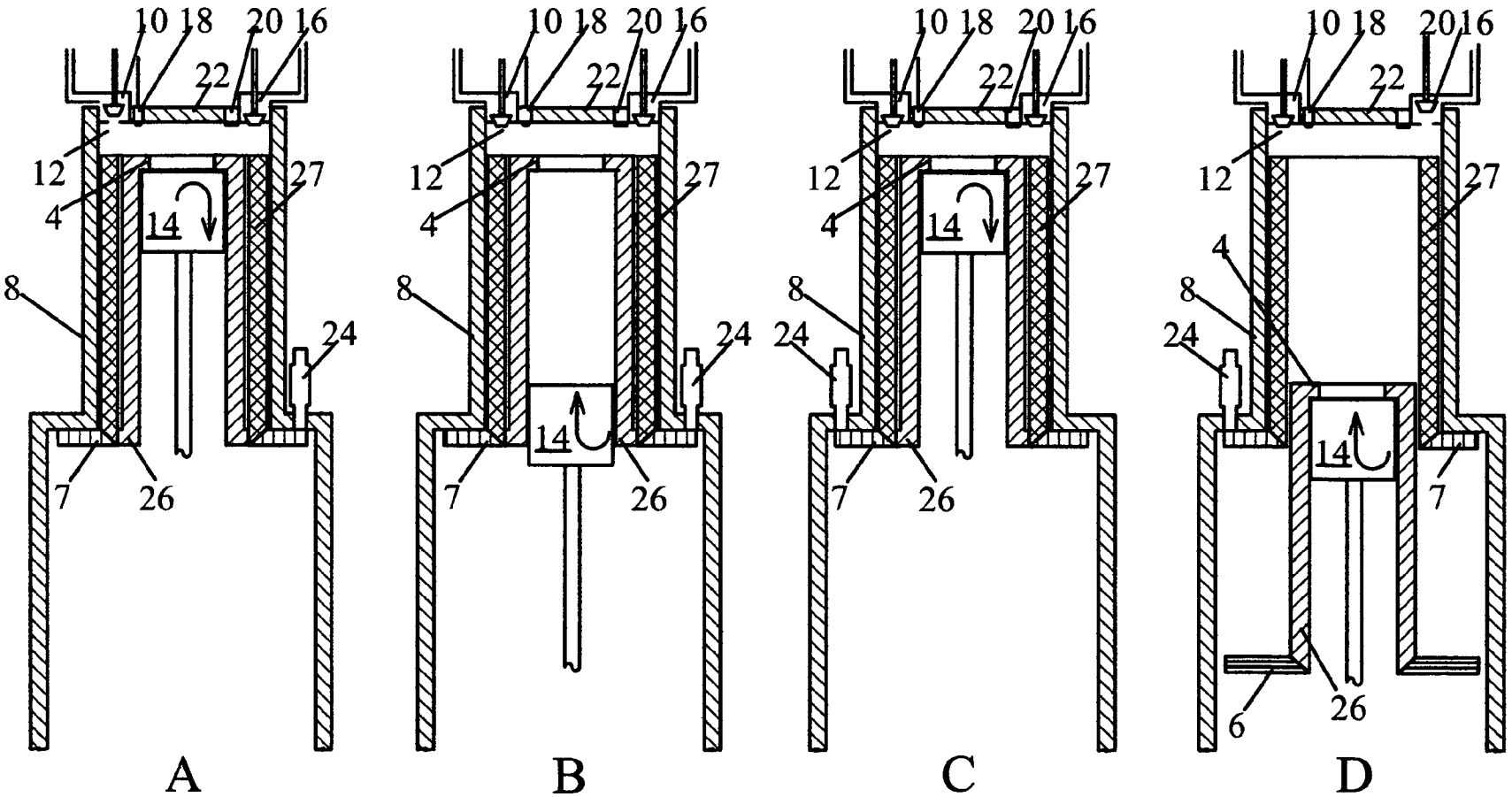
FIG. 4 shows the low power operation of the first alternate embodiment of this invention.
Figure 5:
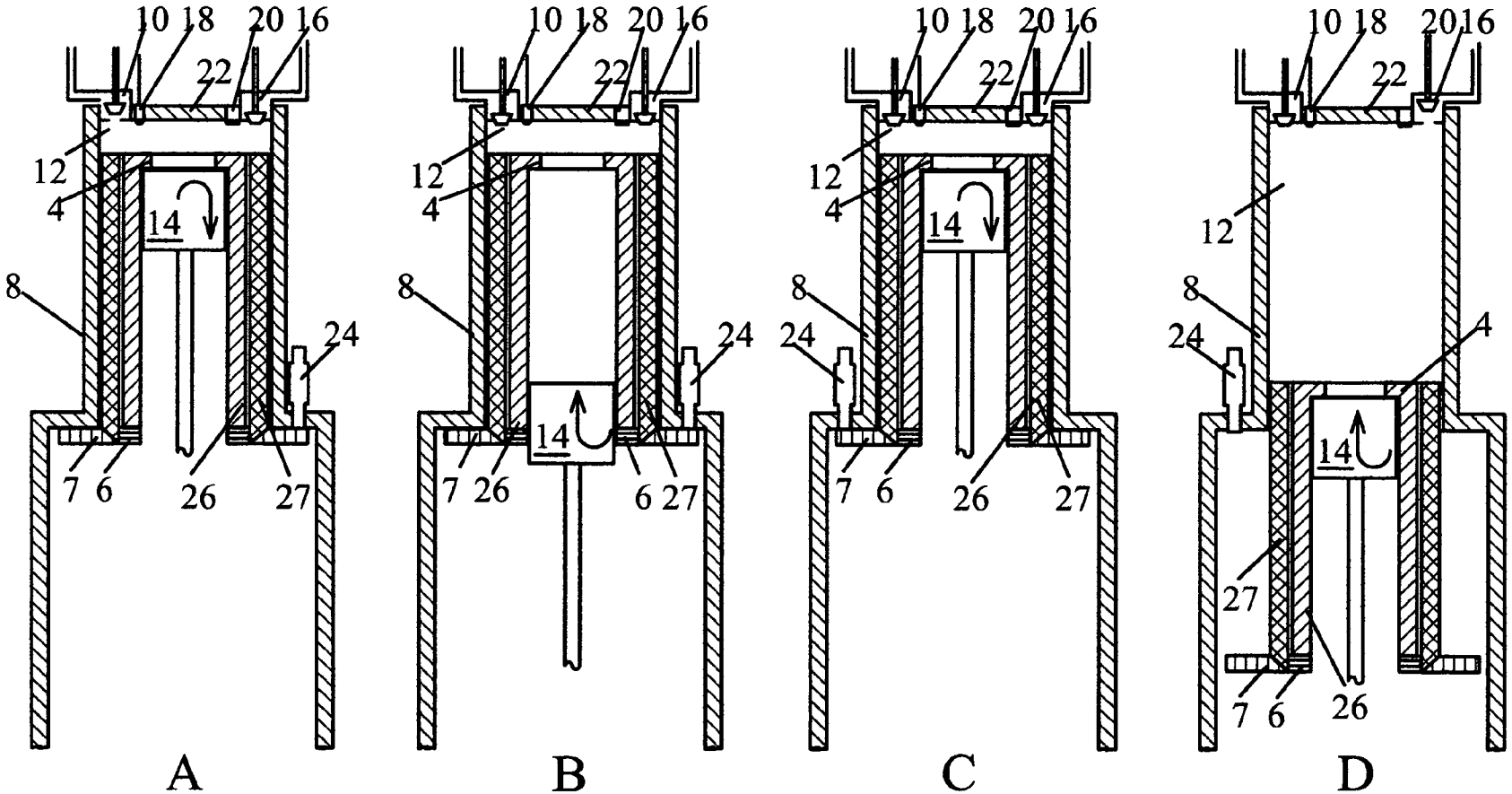
FIG. 5 shows the high power operation of the first alternate embodiment of this invention.

FIGS. 3 to 5—The First Alternate Embodiment

FIG. 3 shows the first alternate embodiment of this invention. It is second sleeve 27, with first sleeve 26 inside of it. Down or downward means away from cylinder head 22, and up or upward means toward cylinder head 22. Top means near cylinder head 22 and bottom means away from cylinder head 22.

Second sleeve 27 has second sleeve tang 7 at the bottom projecting out perpendicular to the outside of second sleeve 27. Piston 14 fits inside of first sleeve 26, first sleeve 26 fits inside of second sleeve 27, and second sleeve 27 in turn fits inside of the engine cylinder 12. The outside of second sleeve 27 has piston ring groove 28 cut in it.

Second sleeve tang 7 is made of material that is attracted by electro-magnet 24.

Shown in FIG. 4 and FIG. 5 is four stroke engine 8 comprising air inlet valve 10, engine cylinder 12, piston 14, exhaust valve 16, fuel injector 18 and igniter 20 for adding heat, cylinder head 22, electro-magnet 24, first sleeve 26, and second sleeve 27. First sleeve 26 has first sleeve magnets 6 that along with material that is attracted by a magnet in engine cylinder 12 create a magnetic force for keeping first sleeve 26 at the top of engine cylinder 12 until a predetermined force caused by the heating of the air makes it move.

Second sleeve 27 is shown with second sleeve tang 7 that along with electro-magnet 24 keeps it at the top of engine cylinder 12 until a predetermined force caused by the heating of the air makes it move when electro-magnet 24 is turned off.

Air inlet valve 10, exhaust valve 16, fuel injector 18, and igniter 20 are all in cylinder head 22. First sleeve magnets 6 on first sleeve 26 act as projections and are used for transferring force between first sleeve 26 and second sleeve 27.

OPERATION

FIGS. 4 and 5—First Alternate Embodiment

FIG. 4 shows the operation of the first alternate embodiment during low power operation. Air is taken into four stroke engine 8 between FIGS. 4A and 4B. During this downward intake stroke of piston 14, material in engine cylinder 12 that is attracted by first sleeve magnets 6 create a magnetic force for keeping first sleeve 26 at the top of engine cylinder 12. In addition second sleeve tang 7 and electro-magnet 24, create a magnetic force for keeping second sleeve 27 at the top of engine cylinder 12. Air is compressed between FIGS. 4B and 4C. During the upward compression stroke of piston 14, first sleeve magnets 6 create a magnetic force for keeping first sleeve 26 at the top of engine cylinder 12. In addition second sleeve tang 7 and electro-magnet 24, create a magnetic force for keeping second sleeve 27 at the top of engine cylinder 12. Heat is added in FIG. 4C. The charge is expanded between FIGS. 4C and 4D. At the start of the downward expansion stroke, second sleeve tang 7 and electro-magnet 24, create a magnetic force for keeping second sleeve 27 at the top of engine cylinder 12. First sleeve magnets 6 are overpowered by the predetermined forces caused by the heating of the air pushing against the top of first sleeve 26, and first sleeve 26 moves down as projection 4 transfers force from first sleeve 26 to piston 14. Air is exhausted between FIGS. 4D and 4A. During the upward exhaust stroke, projection 4 transfers force from piston 14 to first sleeve 26 and moves first sleeve 26 to the top of engine cylinder 12.

FIG. 5 shows the operation of the first alternate embodiment during high power operation. Air is taken into four stroke engine 8 between FIGS. 5A and 5B. During this downward intake stroke of piston 14, material in engine cylinder 12 that is attracted by first sleeve magnets 6 create a magnetic force for keeping first sleeve 26 at the top of engine cylinder 12. In addition second sleeve tang 7 and electro-magnet 24, create a magnetic force for keeping second sleeve 27 at the top of engine cylinder 12. Air is compressed between FIGS. 5B and 5C. During this upward compression stroke of piston 14, first sleeve magnets 6 create a magnetic force for keeping first sleeve 26 at the top of engine cylinder 12. In addition second sleeve tang 7 and electro-magnet 24, create a magnetic force for keeping second sleeve 27 at the top of engine cylinder 12. Heat is added in FIG. 5C. The charge is expanded between FIGS. 5C and 5D. At the start of the downward expansion stroke, electro-magnet 24 is turned off and the pressure forces pushing against the top of second sleeve 27 moves second sleeve 27 down as first sleeve magnets 6 acting as a projection transfer force from second sleeve 27 to first sleeve 26. In addition, first sleeve magnets 6 are overpowered by predetermined forces caused by the heating of the air pushing against the top of first sleeve 26, and first sleeve 26 moves down as projection 4 transfers force from first sleeve 26 to piston 14. Air is exhausted between FIGS. 5D and 5A. During the upward exhaust stroke, projection 4 transfers force from piston 14 to first sleeve 26 and moves first sleeve 26 to the top of engine cylinder 12, and first sleeve magnets 6 acting as a projection transfer force from first sleeve 26 to second sleeve 27 and moves second sleeve 27 to the top of engine cylinder 12.

CONCLUSION

The "A Four Stroke Engine with a Fuel Saving Sleeve" has the following advantages:

It depletes all of the pressure forces in the engine cylinder prior to the exhaust valve opening; thus making the engine more efficient.

It can enable super-charging to more than double the power output of the engine.

I claim:

1. A four stroke engine comprising an engine cylinder, a piston, a means for adding heat, a cylinder head, at least one sleeve with all or part of the end of said sleeve nearest said cylinder head exposed to a clearance volume between said cylinder head and said piston, a means for transferring a mechanical force between said sleeve and said piston during the expansion and exhaust strokes but not during the intake and compression strokes, and a means for creating a magnetic force inside said four stroke engine for keeping said sleeve at said cylinder head end of said engine cylinder until predetermined forces from the heating of the air make it move during the expansion strokes and said piston makes it move during the exhaust strokes.

2. Said four stroke engine of claim 1 wherein said means for transferring a mechanical force between said sleeve and said piston during the expansion and exhaust strokes but not during the intake and compression strokes, is a projection on said sleeve.

3. Said four stroke engine of claim 1 wherein said means for creating a magnetic force inside said four stroke engine for keeping said sleeve at said cylinder head end of said engine cylinder until predetermined forces from the heating of the air make it move during the expansion strokes and said piston makes it move during the exhaust strokes is at least one magnet attached to said sleeve attracting material in said engine cylinder.

* * * * *